US009295603B1

(12) United States Patent
Selnow

(10) Patent No.: US 9,295,603 B1
(45) Date of Patent: Mar. 29, 2016

(54) TABLE COVER

(71) Applicant: Patrice Yvonne Selnow, Fairfax Station, VA (US)

(72) Inventor: Patrice Yvonne Selnow, Fairfax Station, VA (US)

( * ) Notice: Subject to any disclaimer, the term of this patent is extended or adjusted under 35 U.S.C. 154(b) by 0 days.

(21) Appl. No.: 14/449,598

(22) Filed: Aug. 1, 2014

Related U.S. Application Data

(60) Provisional application No. 61/958,631, filed on Aug. 2, 2013, provisional application No. 62/008,175, filed on Jun. 5, 2014.

(51) Int. Cl.
*A47B 13/08* (2006.01)
*A61G 13/10* (2006.01)

(52) U.S. Cl.
CPC ..... *A61G 13/10* (2013.01)

(58) Field of Classification Search
CPC . A47G 21/167; A47G 11/003; A47G 11/004; A47G 11/006; A47B 13/086
USPC ..... 108/90
See application file for complete search history.

(56) References Cited

U.S. PATENT DOCUMENTS

| | | | | | |
|---|---|---|---|---|---|
| 1,210,004 | A * | 12/1916 | Roe | 108/90 |
| 1,689,890 | A * | 10/1928 | Roberts | 108/90 |
| 2,283,828 | A * | 5/1942 | Strombach | 108/90 |
| 2,901,861 | A * | 9/1959 | Oakes | 108/90 |
| 3,156,280 | A * | 11/1964 | Affholter | 108/90 |
| 3,583,337 | A * | 6/1971 | Yokeley | 108/90 |
| 4,067,167 | A * | 1/1978 | Anderson | 52/796.11 |
| 4,813,166 | A * | 3/1989 | Drake | 38/140 |
| 5,778,802 | A | 7/1998 | Hairston | |
| 6,240,667 | B1 * | 6/2001 | Harney et al. | 40/649 |
| 6,578,496 | B2 * | 6/2003 | Guard et al. | 108/25 |
| 2002/0178975 | A1 * | 12/2002 | Lewis et al. | 108/90 |
| 2005/0132938 | A1 * | 6/2005 | Jones | 108/90 |
| 2006/0180056 | A1 * | 8/2006 | Dorholt | 108/90 |
| 2010/0132595 | A1 * | 6/2010 | Gledhill | 108/90 |
| 2012/0298016 | A1 * | 11/2012 | Forlin | 108/90 |

* cited by examiner

*Primary Examiner* — Hanh V Tran
(74) *Attorney, Agent, or Firm* — Attentive Law Group, PLLC; James Miner

(57) ABSTRACT

A table cover may include (A) a top portion; (B) a pair of opposing side portions on opposite sides of the top portion, each side portion including (i) a vertical side portion attached to a side edge of the top portion, and (ii) a horizontal side portion, attached to a lower edge of the vertical side portion, for extending under a supporting table; (C) a front portion attached to the front edge, of the top portion, at an upper edge of the front portion, the front portion having opposing front seam edges respectively attached to a respective side seam edges of a corresponding side portion, the front portion further including a vertical front face; and a flap attached to a lower edge of the vertical front face, and the flap extending under the supporting table. The flap may be defined within the front portion by a pair of slits.

19 Claims, 10 Drawing Sheets

TABLE COVER

RELATED PATENT APPLICATION

This application claims priority to both U.S. Provisional Patent Application 61/958,631 filed Aug. 2, 2013 and U.S. Provisional Patent Application 62/008,175 filed Jun. 5, 2014, the content of both applications incorporated herein by reference in their entirety.

BACKGROUND OF THE INVENTION

The invention is directed to table covers, and in particular to table covers for medical tables. Medical tables are common in the offices of doctors and other healthcare providers.

BRIEF SUMMARY OF THE INVENTION

The invention provides a table cover (10) for placement on a supporting table, the table cover (10) comprising: (A) a top portion (20) extending across the supporting table, the top portion including opposing side edges (22), a back edge (24), and a front edge (26); (B) a pair of opposing side portions (30) disposed on opposite sides of the top portion, each side portion (30) including: (i) a vertical side portion (32) attached to a side edge (22) of the top portion (20) and running along the corresponding side edge (22) of the top portion (20), the vertical side portion (32) having a lower edge (33), and (ii) a horizontal side portion (34) attached to the lower edge (33) of the vertical side portion (32) and running along the lower edge (33) of the side portion, each horizontal side portion (34) for extending under a side of the supporting table, each horizontal side portion (30) includes a back side edge (36) and a front side seam edge (51), the back side edge (36) forming a segment of the back edge (24); (C) a front portion (40) attached to the front edge (26), of the top portion (20), at an upper edge (44) of the front portion (40), the front portion (40) having opposing front seam edges (52) respectively attached, at a seam (50), to a respective side seam edges (51) of a corresponding side portion (30), the front portion (40) further including: (i) a vertical front face (42) attached, at an upper edge thereof, to the front edge (26) of the top portion (20), the vertical front face (42) further having a lower edge (43), and (ii) a flap (45) attached to the lower edge (43) of the vertical front face (42) along a portion of a width of the vertical front face (42), and the flap (45) extending under the supporting table, and wherein the flap (45) is defined within the front portion (40) by a pair of slits (60).

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE INVENTION

Hereinafter, aspects of the table cover in accordance with various embodiments of the invention will be described. As used herein, any term in the singular may be interpreted to be in the plural, and alternatively, any term in the plural may be interpreted to be in the singular.

Figure 10:
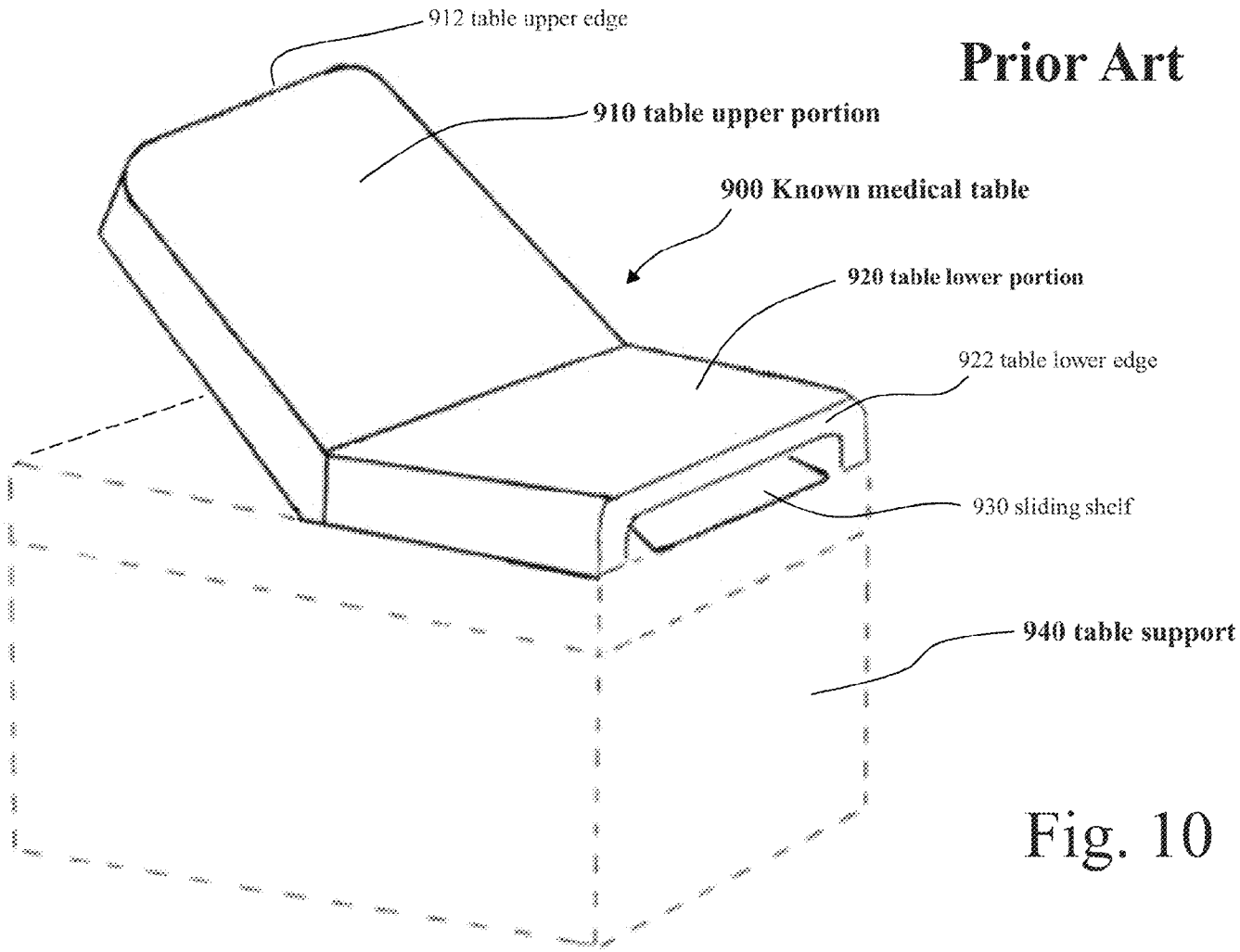
FIG. 10 is a perspective view of a known "Prior Art" medical table.

The invention is directed to a table cover, and in particular a table cover for a known medical table. Medical tables are common in the offices of doctors and other healthcare providers. FIG. 10 is a perspective view of a known prior art medical table 900. As shown, the medical table may be supported on a table support 940 in a well-known manner.

As shown in FIG. 10, the medical table 900 includes a table upper portion 910 and a table lower portion 920. The table upper portion 910 includes a table upper edge 912. In a well-known manner, the table upper portion 910 may be pivotably disposed relative to the table lower portion 920, such that the angle of the table upper portion is adjustable. As shown, the table lower portion 920 includes a table lower edge 922. A sliding shelf 930 may be disposed underneath the table lower portion 920. In known manner, the sliding shelf 930 may be retracted within the table lower portion 920 in a refracted position, or alternatively extended out of the table lower portion 920 as desired. The medical table 900 includes a covering integrally constructed as part of the medical table. For example, such a covering for the medical table 900 might be constructed of vinyl or some other suitable material.

Known medical tables, such as that shown in FIG. 10 for example, are exposed to extensive use day to day and year to year. As a result, the top of medical tables, and specifically the covering of such medical tables, often rip, tear, or peel and in general suffer deterioration over time. A problem exists in the known technology in that it is time-consuming, costly, and otherwise difficult to address such deterioration of a medical table. In particular, it is time-consuming and costly to remove the covering of a medical table and replace that removed covering with a new covering. The invention addresses this problem and other problems with known technology.

Figure 1:
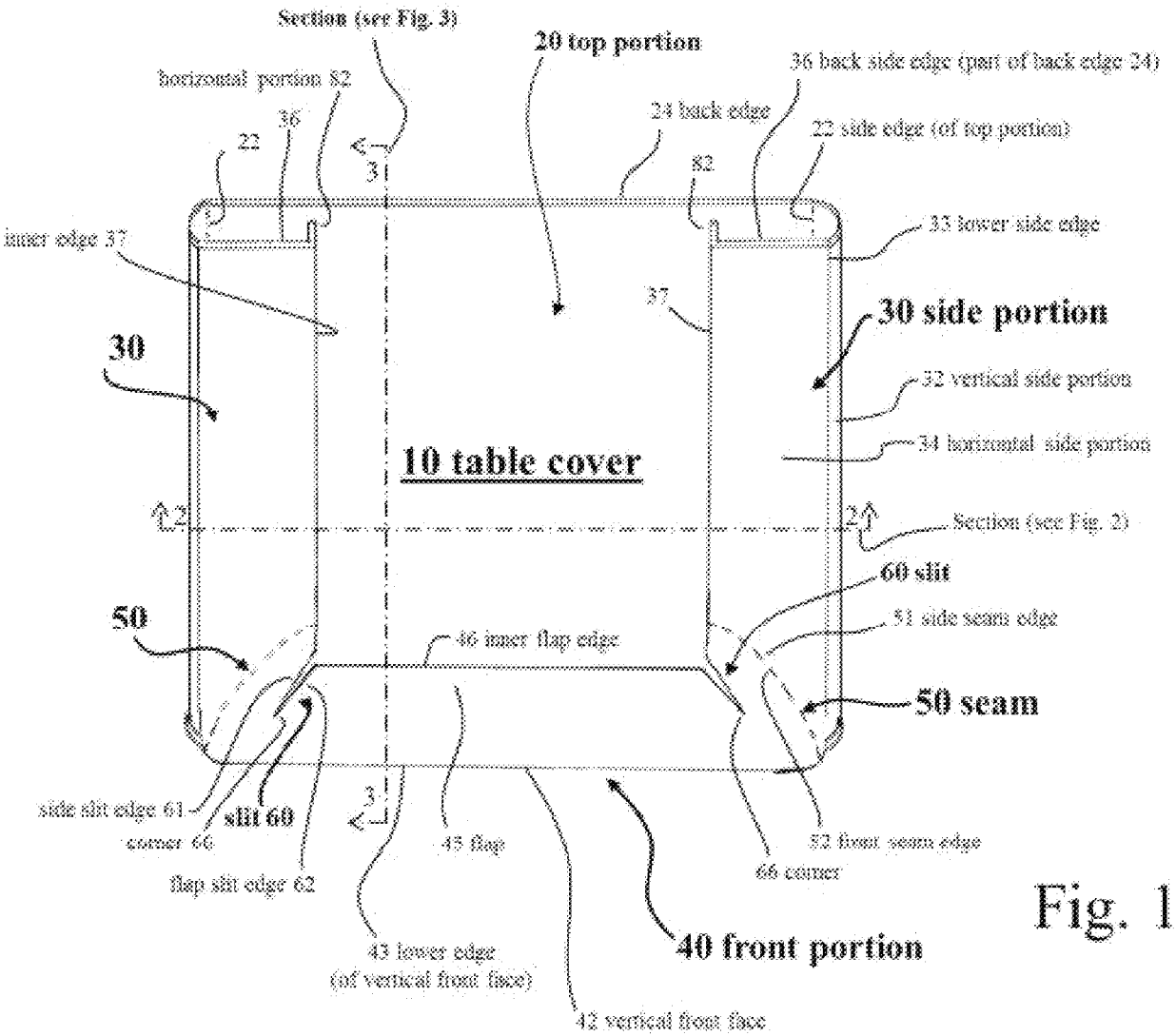
FIG. 1 is a perspective view of a table cover in accordance with one embodiment of the invention.

FIG. 1 is a perspective view of a table cover in accordance with one embodiment of the invention. The table cover provides a protective cover for a supporting table, and in particular a protective cover for a medical table, such as the table of FIG. 10.

Figure 2:
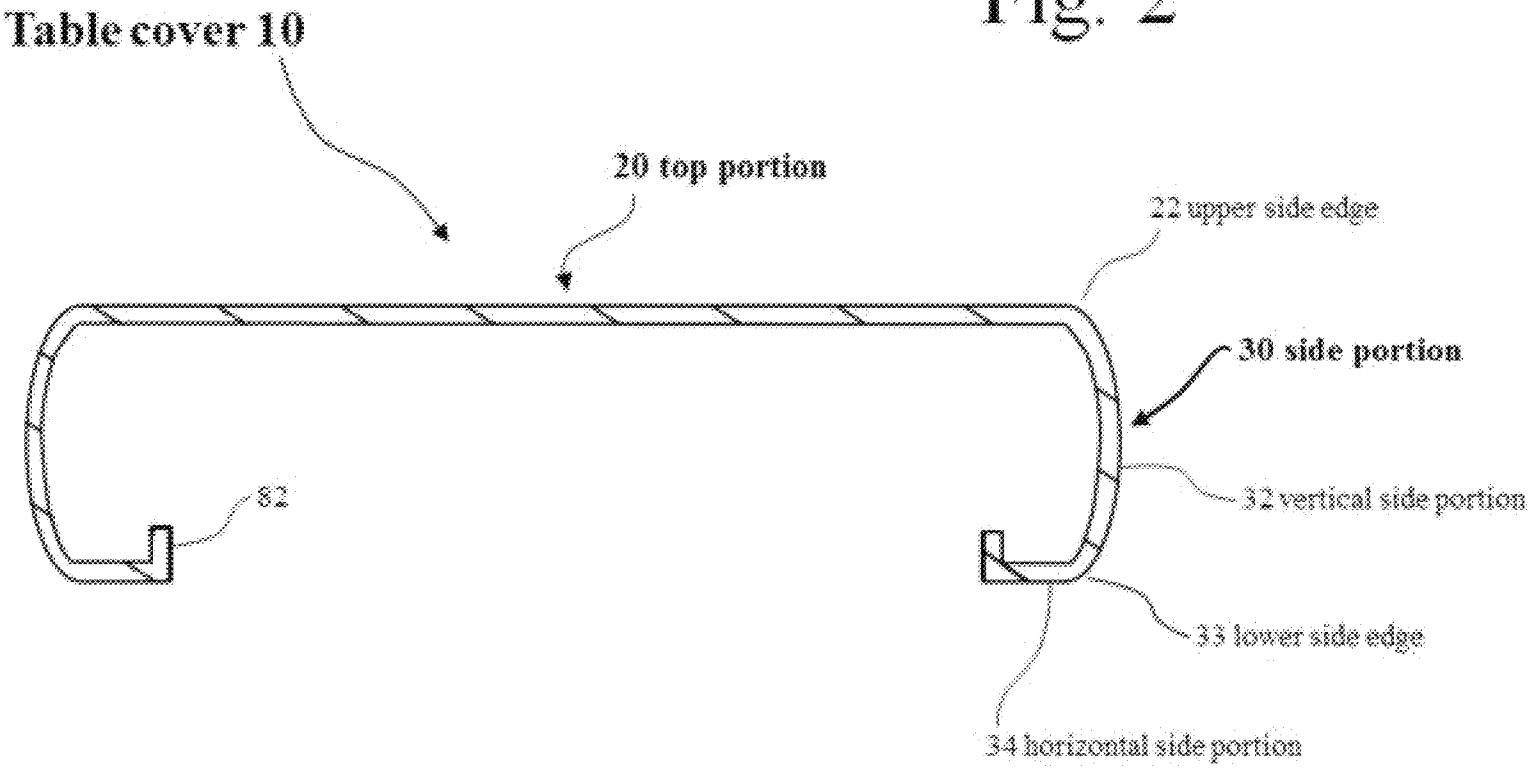
FIG. 2 is a cross-sectional view of the table cover along line 2-2 of FIG. 1 in accordance with one embodiment of the invention.
Figure 3:
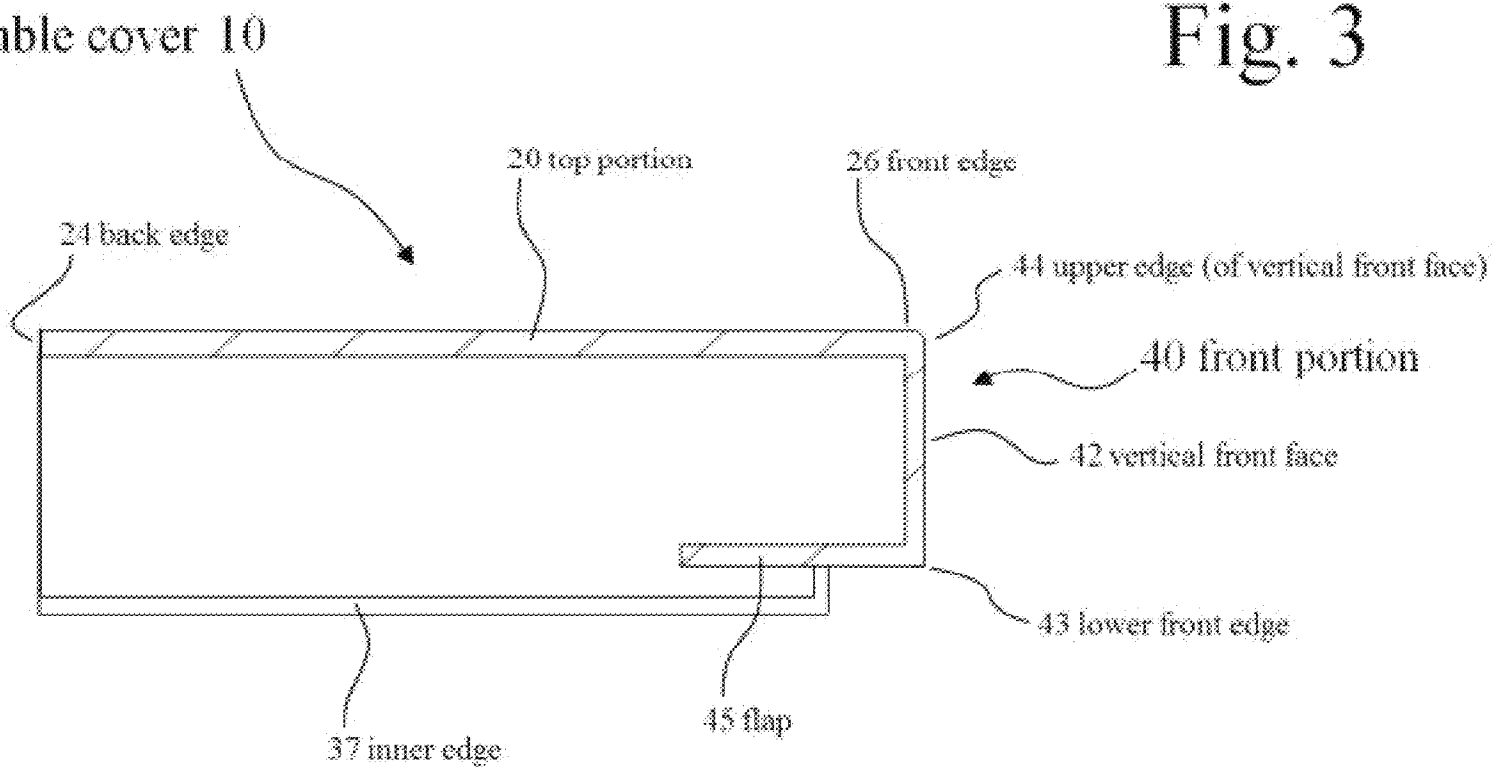
FIG. 3 is a cross-sectional view of the table cover along line 3-3 of FIG. 1 in accordance with one embodiment of the invention.

Related to FIG. 1, FIG. 2 is a cross-sectional view of the table cover along line 2-2 of FIG. 1 in accordance with one embodiment of the invention. Also, FIG. 3 is a cross-sectional view of the table cover along line 3-3 of FIG. 1 in accordance with one embodiment of the invention.

As shown in FIG. 1, the table cover 10 includes a top portion 20 that extends across and over a supporting table. The top portion includes opposing side edges 22 disposed and running along each side of the top portion 20. The top portion 20 also includes a back edge 24 running along a back portion of the table cover. Further, the top portion 20 includes a front edge 26 (shown in FIG. 3). The front edge 26 runs from side to side between the front upper corners of the table cover 10.

As shown in FIG. 1, the table cover 10 further includes a pair of opposing side portions 30. The opposing side portions 30 are disposed on opposite sides of the top portion. Each opposing side portion 30 includes a vertical side portion 32 and a horizontal side portion 34.

The vertical side portion 32 is attached to a side edge 22 of the top portion 20 and runs along the corresponding side edge 22 of the top portion 20. The vertical side portion 32 includes a lower edge 33. The horizontal side portion 34 is attached to the lower edge 33 of the vertical side portion 32 and runs along the lower edge 33 of side portion. In use of the table cover, upon a supporting table, each horizontal side portion 34 extends under a perspective side of the supporting table. As shown in FIG. 1, each horizontal side portion 30 includes a back side edge 36 and a front side seam edge 51. As shown, the back side edge 36 forms a segment of the back edge 24, i.e., as characterized herein, the back side edge 36 is a portion of the back edge 24.

The table cover 10 of FIG. 1 further includes a front portion 40. The front portion 40 is attached to the front edge 26 of the top portion 20, as shown in FIG. 3, for example. More specifically, an upper edge 44 (of the front portion 40) is attached to the front edge 26 of the top portion 20. The front portion 40 includes a flap 45, which extends underneath the supporting table and is attached thereto, for example using staples.

The front portion 40 includes opposing front seam edge 52, as shown in FIG. 1. Each front seam edge 52 (of the front portion 40) is attached at opposing sides of the table cover 10 to a respective side seam edge 51 of a corresponding side portion 30.

Figure 4:
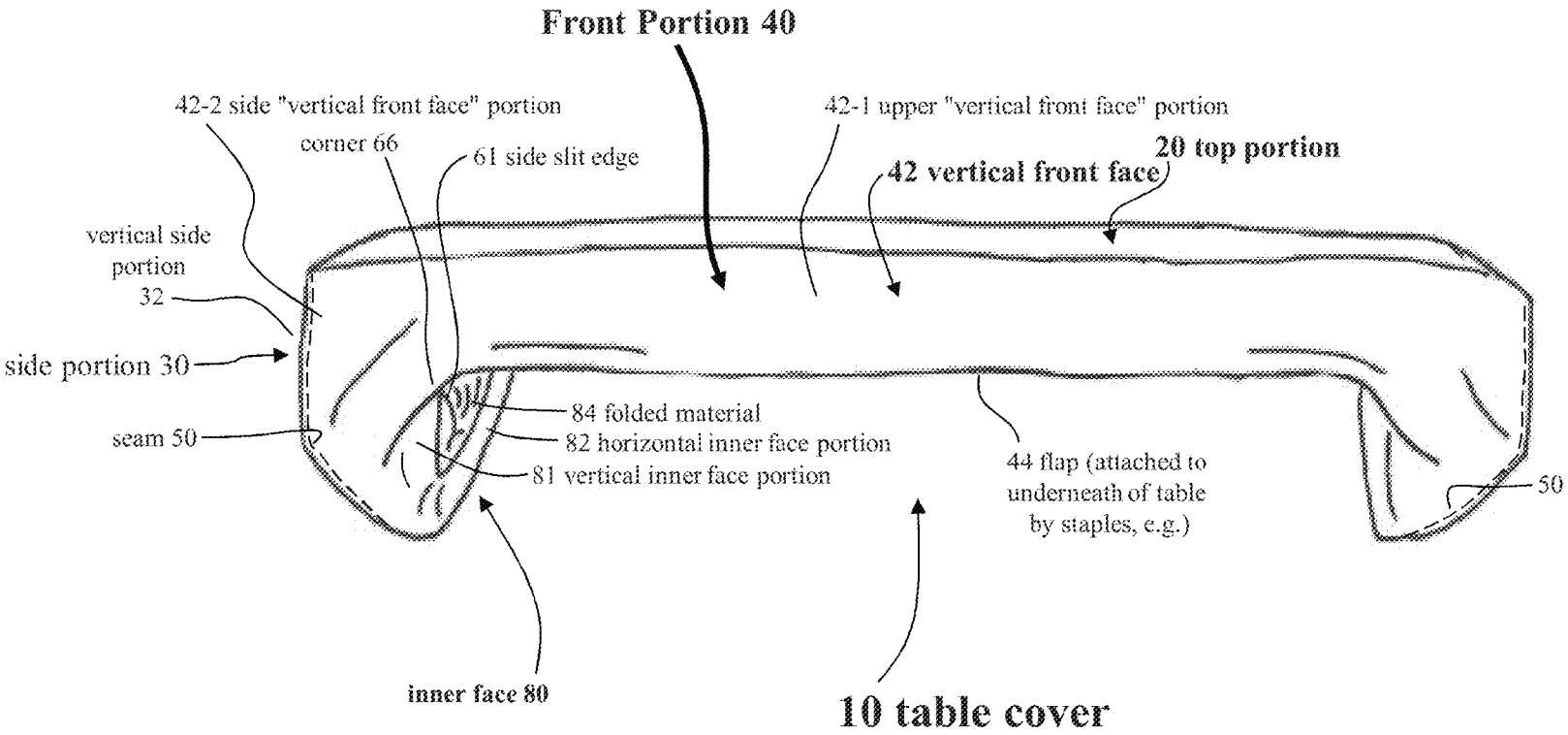
FIG. 4 is a perspective view of a table cover in accordance with an embodiment of the invention.

As shown in FIGS. 1 and 3, the front portion 40 further includes a vertical front face 42 and a flap 45. The vertical front face 42 (of the front portion 40) is attached, at an upper edge thereof, to the front edge 26 of the top portion 20. In particular, the vertical front face 42 is shown in FIGS. 3 and 4. The vertical front face 42 includes a lower edge 43.

The front portion 40, as characterized herein, further includes a flap 45. The flap 45 is attached to the lower edge 43 of the vertical front face 42 along a portion of a width of the vertical front face 42. As shown, the flap 45 extends under the supporting table and is secured to the supporting table in some suitable manner, such as using adhesive or by staples, for example. The flap 45 is defined within the front portion by a pair of slits 60. The flap 45 includes an inner flap edge 46.

As shown in FIGS. 1 and 4, each slit 60 (disposed on respective sides of the table cover 10) includes a side slit edge 61 and a flap slit edge 62. The side slit edge 61 extends between an inner edge 37 of a side portion 30 and terminates in a corner 66. On the other hand, the flap slit edge 62 extends between the inner flap edge 46 (of the flap 45) and terminates in the corner 66. This arrangement, including the slits 60 and the seams 50, allows the flap 45 to be extended and secured underneath the front center portion of the supporting table—hand in hand with the side portion extended and secured underneath a side of the supporting table.

In accordance with one embodiment of the invention, the table cover including the top portion 20, the opposing side portions 30 and the front portion 40 may be integrally formed, i.e., integrally formed of a single sheet of material.

As shown in FIG. 1 and described above, the side seam edge 51 is attached to the front seam edge 52 at a seam 50. As shown in FIG. 1, such portion of the seam 50 serves to connect the side portion 30 with the front portion 40. In accordance with embodiments of the invention, such seam 50 further extends in a vertical manner up what might be characterized as a corner of the table cover 10. That is, such seam 50 further serves to connect (on each side) a vertical side portion 32, of the side portion 30, with a corresponding side "vertical front face" portion 42-2 (of the front portion 40).

Accordingly, the seam 50 may be constituted by (1) a threaded connection between a side seam edge 51, of a side portion 30, and a corresponding front seam edge 52 of the front portion 40, and (2) a threaded connection between a vertical side portion 32 and a corresponding side "vertical front face" portion 42-2. However, the invention is not limited to the seam 50 constituted by a threaded connection. Rather, other arrangements may be utilized such as a connection using lacing, adhesive, snaps, or some other suitable connective method. With further reference to FIGS. 1 and 4 in particular, the seam 50 may be characterized as being disposed "outside" a corresponding one of the slits 60.

As described above, the vertical front face 42 (of the front portion 40) includes a top front face portion 42-1 and two side front face portions 42-2. Such two side front face portions 42-2 are disposed on opposing sides of the top front face portion 42-1. In accordance with embodiments of the invention, the top front face portion 42-1 and two side front face portions 42-2 may be integral with each other and form a continuous surface. In further explanation, the top front face portion 42-1 and the two side front face portions 42-2 might be characterized as in the shape of an inverted elongated "U".

Hereinafter, aspects of what is herein characterized as an "inner face 80" will be described, in accordance with one embodiment of the invention. As shown in FIG. 4, the table cover 10 includes an inner face 80 that is constituted by the positioning of the material (of the table cover 10) around a supporting structure of the supporting table. In other words, the material of the table cover 10 is effectively wrapped around a side structure of the supporting table. As a result of this "wrapping" of the material of the table cover 10, an inner face 80 is formed. Accordingly, such inner face 80 is disposed adjacent (a) a corresponding side front face portion 42-2 and (b) a corresponding horizontal side portion 34 (see in particular FIG. 2)

The inner face 80 is herein characterized as including a vertical "inner face" portion 81 and a horizontal "inner face" portion 82. The vertical inner face portion 81 is, accordingly, adjacent to a corresponding side "vertical front face" portion 42-2. Further, the vertical inner face portion 81 might be characterized as being at a right angle to the corresponding side "vertical front face" portion 42-2, i.e., in that the material is wrapped around a side support portion of the supporting table. The material, e.g. fabric, is folded upon itself as needed, i.e., to conform to the existing table interior angle for a smooth cover fit. Such folding of the fabric may of course include bunching of the material and doubling-up of the material, for example.

As described above, the inner face 80 further includes a horizontal inner face portion 82. The horizontal inner face portion 82 runs along a corresponding side of the supporting table. Accordingly, the horizontal inner face portion 82 is disposed at right angle to the horizontal side portion 34 (see FIG. 2) on each side of the table cover.

Accordingly, in this embodiment of the invention, the vertical inner face portion 81 and the horizontal inner face portion 82 may be characterized as constituting and "L" shaped interior vertical surface. Furthermore, the horizontal inner face portion 82, the horizontal side portion 34 (see FIG. 2) and the vertical side portion 32 (see FIG. 1) collectively constitute a wraparound of a side portion of the supporting table.

As described above, FIG. 1 is a perspective view of the table cover 10 in accordance with one embodiment of the invention. The edges of the side portion and the edges of the front portion may be characterized as forming a "U" shape. More specifically to explain, the flap 45 terminates (on an inner side) by an inner flap edge 46, as shown in FIG. 1, for example. Further, each opposing horizontal side portion 34 terminates on an inner side by an inner edge 37. Accordingly, the inner flap edge 46 and two opposing inner edges 37 constitute the shape of a "U". In such "U" shape, the slits 60 are respectively disposed at respective corners of such "U" shape.

As described above, the table cover 10 may be constructed of any suitable material such as vinyl, plastic, fabric, cloth, canvas, and/or a proprietary material, for example. In general, it may be desired to use a material that is moisture, stain or bacterial resistant. Illustratively, a fabric called CRYPTON, which is moisture resistant, easy to clean, soft and breathable, may be used. Such material may be provided to afford stain, moisture, odor and bacterial resistance, for example.

The table cover may be attached to the supporting table using appropriate fasteners, as desired. In particular, the flap 45, the horizontal side portions 34, and the horizontal inner face portions 82 may be attached to the supporting table using appropriate connectors including adhesive, double-sided tape, VELCRO, staples and/or other suitable connective methods.

Figure 9:
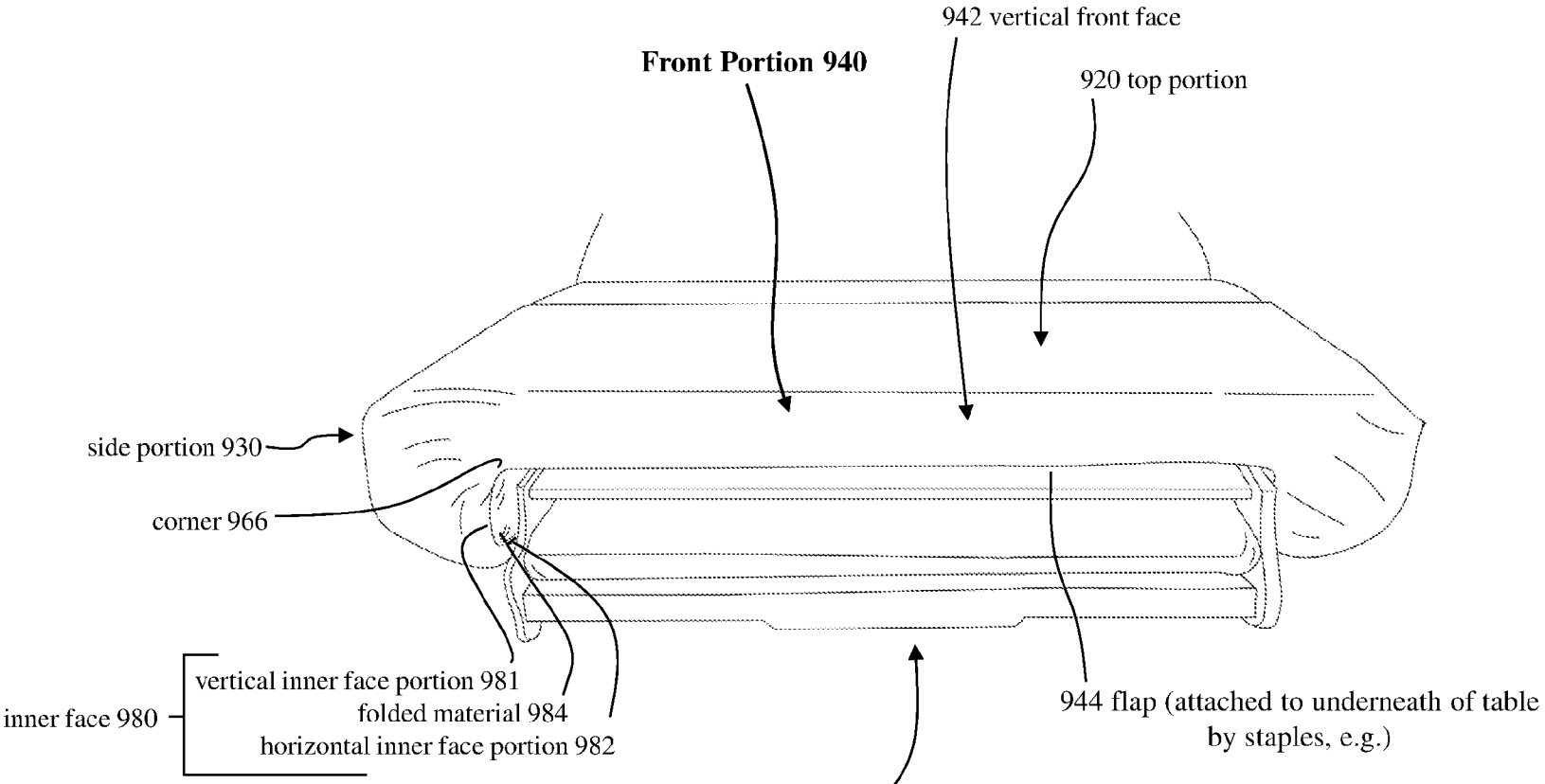
FIG. 9 is a perspective view of a table cover in accordance with an embodiment of the invention.

FIG. 9 is a perspective view of a table cover in accordance with an embodiment of the invention. FIG. 9 shows an arrangement of similar structure to FIG. 4 and is labeled in similar manner.

Figure 5:
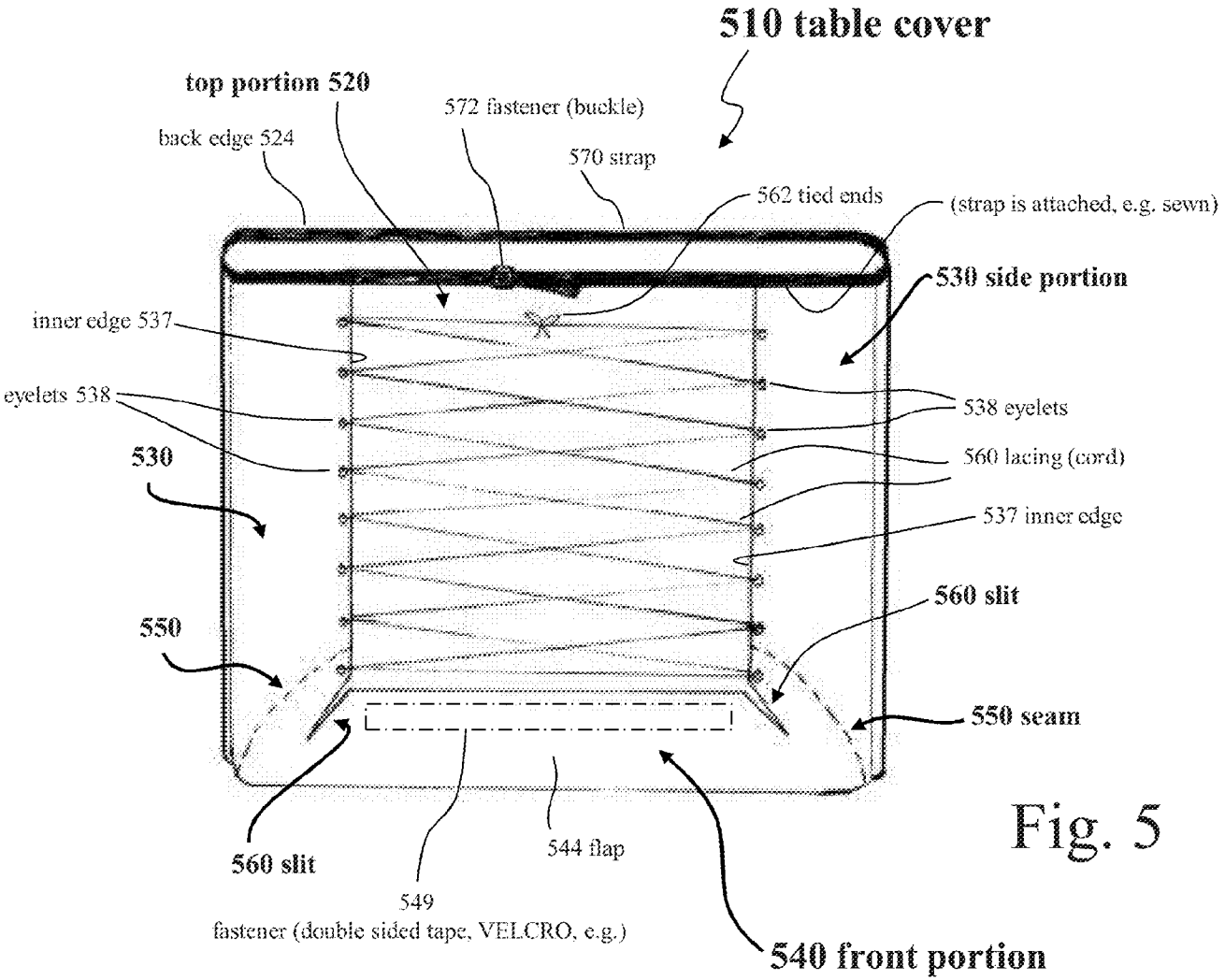
FIG. 5 is a perspective view of a table cover in accordance with a further embodiment of the invention.

FIG. 5 is a perspective view of a table cover 510 in accordance with a further embodiment of the invention. Aspects of the structure of the table cover 510 may be of similar structure to that described above with reference to FIG. 1. In particular, the structure of the seam 550 of FIG. 5 may be similar in nature to the structure of the seam 50 of FIG. 1. Additionally, the structure and arrangement of the slit 560 of FIG. 5 may be similar in nature to the structure of the slit 60 of FIG. 1. Further, the table cover 510 of FIG. 5 may include an front portion 540 of similar nature to the front portion 40 of FIG. 1. As shown in FIG. 5, the front portion 540 may be attached to the supporting table using a suitable fastener 549, such as double-sided tape, VELCRO, or any other suitable fastener, i.e., connective method.

On opposing sides, the table cover 510 includes side portions 530 disposed on opposing sides of a top portion 550. Each of the side portions 530 include in inner edge 537. In this embodiment of the invention, each inner edge 537 may be provided with a series of eyelets 538. The eyelets 538 serve to retain a series of lacing 560. For example, lacing may be constituted by string, cord, rope, or any other suitable material. As shown, the lacing 560 may be sequentially wind through the eyelets 538 and terminated at tied ends 562. Accordingly, such lacing 560 serves to allow tightening of the table cover 510 (including the top portion 520 and the side portions 530). Further, the lacing may be adjusted, i.e. tightened, over time as the material of the table cover 510 may tend to stretch over time. The attachment of the table cover is not limited to a lacing system. VELCRO, VELCRO straps or any connective method (including those described herein) that allows the table cover to be attached to or conform to the existing table may apply and may be used.

The embodiment of FIG. 5 further includes a strap 570 attached to a back edge 524 of the table cover 510. The strap 570 may be attached to the back edge 524 in any suitable manner such as by sewing or by a suitable adhesive, for example. Alternatively, the strap 570 may be integrally formed with the table cover 510 in some manner. In this embodiment, the strap includes a fastener 572, which may be in the form of a buckle or some other suitable connective device, by which the strap may be drawn tight. In general, it is appreciated that the straps described herein are not needed to secure the table cover to the supporting table. Any of the attachment methods described herein may be used in lieu of the described straps, or in addition to the described straps, as desired.

Figure 6:
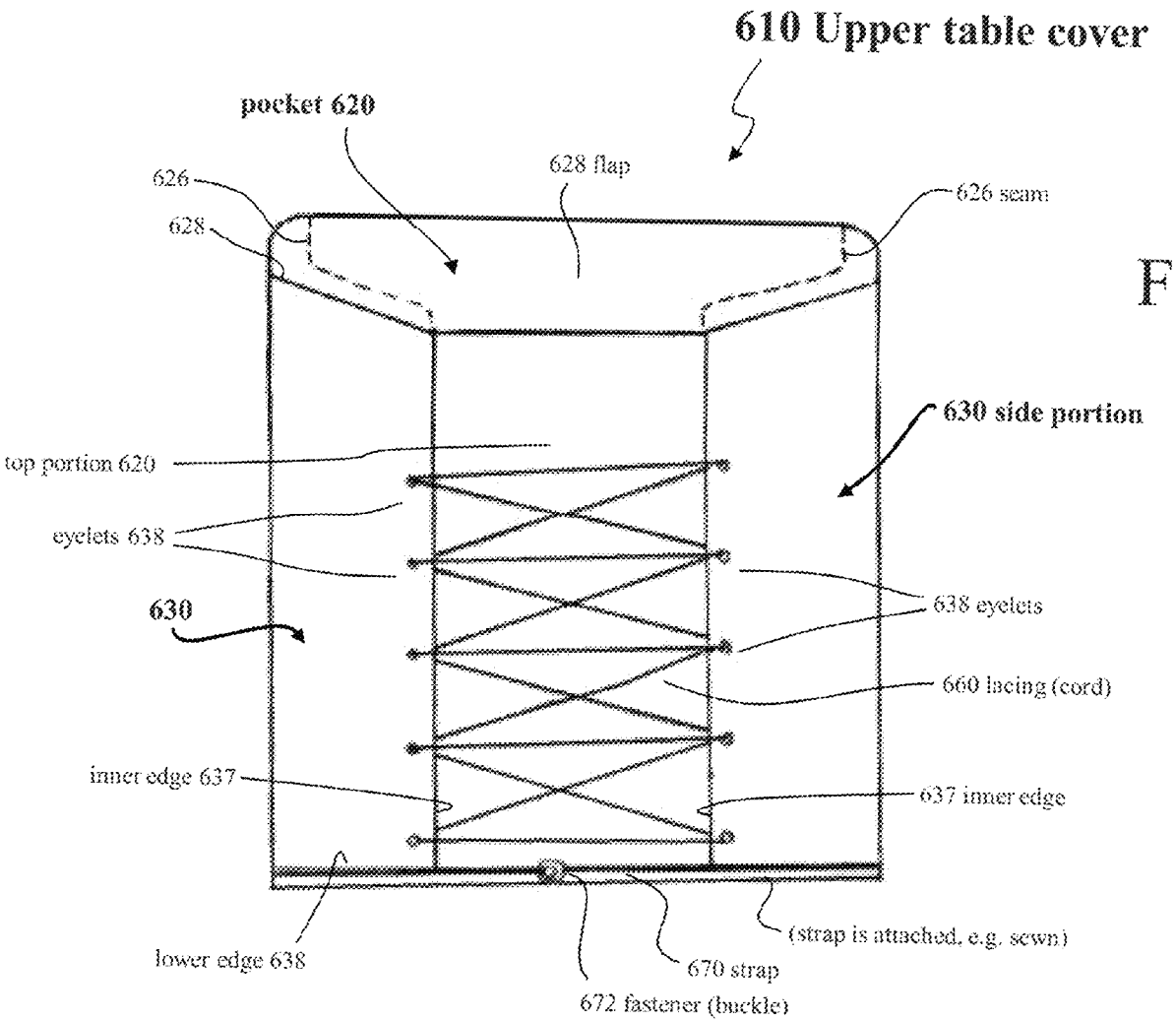
FIG. 6 is a perspective view of an upper table cover in accordance with a further embodiment of the invention.

FIG. 6 is a perspective view of an upper table cover in accordance with a further embodiment of the invention. As described above, the table cover 10 is provided to be disposed on the end of a supporting table, and in particular on the end of a supporting medical table. FIG. 6 shows an upper table cover 610 which is complementary to the table cover 10. The upper table cover 610 is provided to be disposed on a table upper portion 910, as such is shown in FIG. 10.

As shown in FIG. 6, the upper table cover 610 includes a top portion 628 and opposing side portions 630. Each side portion 630 includes an inner edge 637. The inner edge 637 is provided with a series of eyelets 638 through which suitable lacing may be run. As should be appreciated, the lacing may be utilized to secure the upper table cover 610 upon a table upper portion 910, for example. A strap 670 may be attached to a lower edge 638 of the upper table cover 610, such as by sewing. The strap 670 may include a suitable fastener 672, such as a buckle or clip.

An upper portion of the upper table cover 610, in accordance with an embodiment of the invention shown in FIG. 6, includes a pocket 620. The pocket 620 serves to enclose a table upper edge 912 of a table upper portion 910 (see FIG. 10). The pocket 620 may be constituted by a seam 626 and a flap 628 folded over the table upper edge 912, in accordance with one embodiment of the invention.

Figure 7:
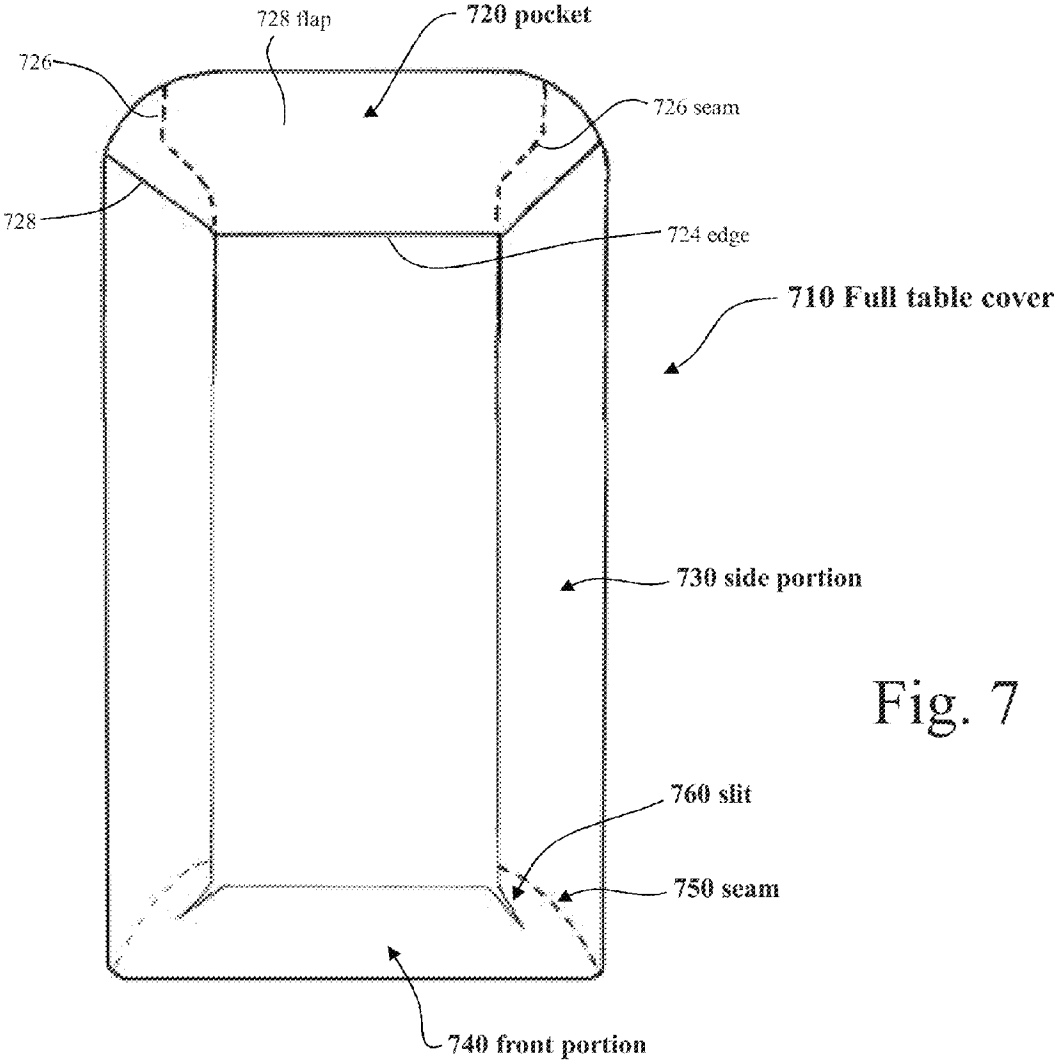
FIG. 7 is perspective view of a full table cover in accordance with a further embodiment of the invention.

FIG. 7 is a perspective view of a full table cover in accordance with a further embodiment of the invention. Aspects of the structure of the table cover 710 of FIG. 7 may be of similar structure to that described above with reference to FIG. 1. In particular, the structure of the seam 750 of FIG. 7 may be similar in structure to the structure of the seam 50 of FIG. 1. Additionally, the structure of the arrangement of the slit 760 of FIG. 7 may be similar in nature to the structure of the slit 60 of FIG. 1. Further, the table cover 710 of FIG. 7 may include an front portion 740 of similar nature to the front portion 40 of FIG. 1.

However, in contrast to the embodiment of FIGS. 1-4, the embodiment of FIG. 7 is in the form of a full table cover 710. Accordingly, such full table cover 710 extends over both a table lower portion 920 as well as a table upper portion 910 (see FIG. 10).

An upper portion of the upper table cover 710, in accordance with the embodiment of the invention shown in FIG. 7, includes a pocket 720. The pocket 720 serves to enclose a table upper edge 912 of a table upper portion 910 (see FIG. 10). The pocket 720 may be constituted by a seam 726 and a flap 728 folded over the table upper edge 912.

Figure 8:
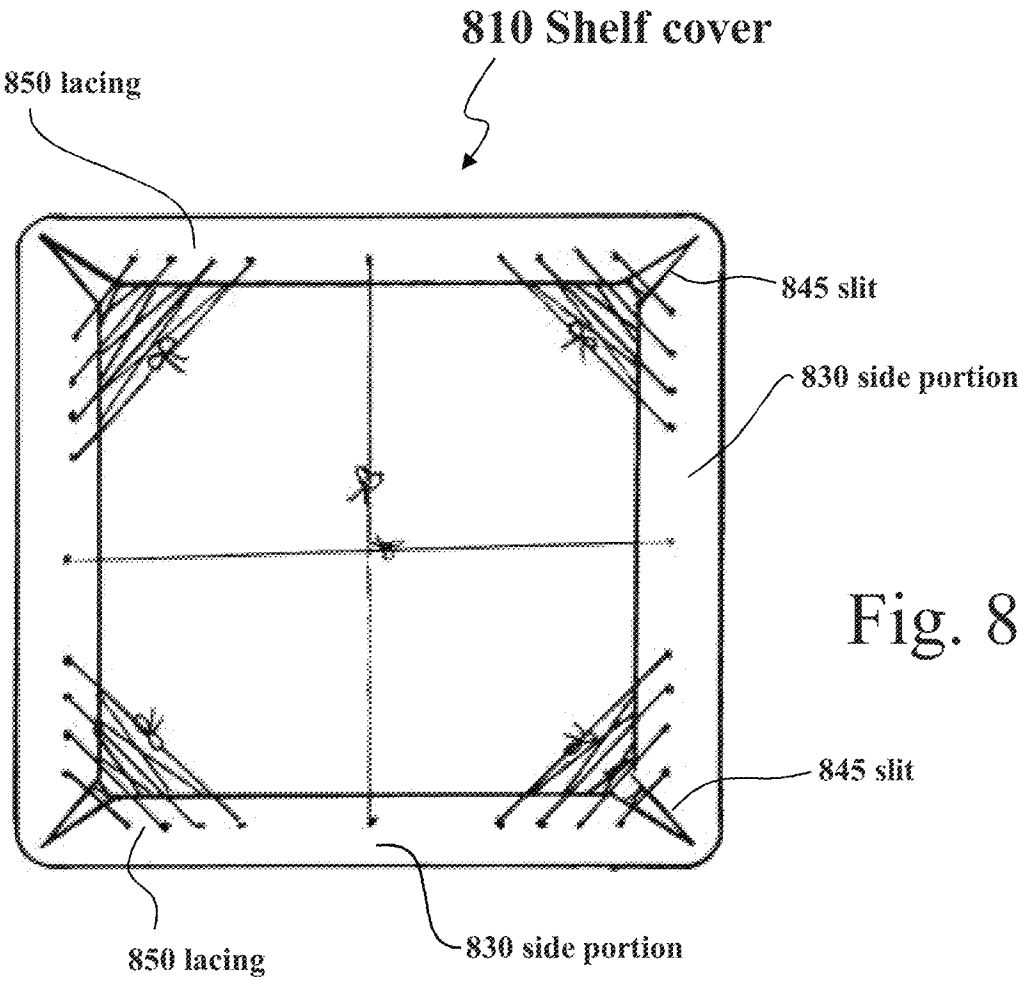
FIG. 8 is a perspective view of a shelf cover in accordance with a further aspect of the invention.

FIG. 8 is a perspective view of a shelf cover in accordance with a further aspect of the invention.

Accordingly, various aspects of the table cover of the invention, in accordance with various embodiments, have been described above. Hereinafter, further aspects of the invention are described.

As described above, the table cover of the invention may be constructed of vinyl or some other suitable material. Such material may be designed to fit snugly around a supporting table.

As described above and shown in the drawings, a lower extent of the table cover, such as the table cover 10 shown in FIG. 1, includes two seamed edges—one on the left and one on the right side of the cover, and on opposing corners of the cover. A short distance from such seam is a diagonal, straight cut, creating a flap, i.e., the flap 45 of FIG. 1, for example. The flap enables the cover to contour to the table edge and attach on the underside of the supporting table, i.e. on the underside of the medical exam table. This arrangement allows free movement of the lower sliding shelf 930 (see FIG. 10) of the supporting table, as described above. The sliding shelf 930 might be characterized as a sliding table, shelf, or drawer.

The table cover of the invention may be stretched slightly and secured to the supporting table. As is also described above, a variety of methods may be used either solely or in combination to secure the table cover to the supporting table.

Various connective methods are described herein. It is appreciated that other suitable connective methods may be used in conjunction with or in lieu of such described connective methods. Such other suitable connective methods may include any of VELCRO, VELCRO straps, straps with fastening clip, straps, staples, adhesive material, adhesive tape, adhesive, lacing, drawstring, threading, sewing, buckle, string, cord, clip, screw, nail, buttons, tack, brads, double-sided tape, tape, elastic materials, elastic tape, glue, and/or snaps, for example. In particular, such methods may be used to secure the table cover to the supporting table including the corners of the supporting table.

In accordance with embodiments of the invention, the particular size of the table cover of the invention may of course be varied as desired. FIG. 1 and FIG. 5 are embodiments of a shorter table cover which is provided to cover only a portion of the lower table. 920 (see FIG. 10). On the other hand, FIG. 7 is a full table cover 710—which is provided to cover the entire supporting table. A short table cover may be provided to cover a small portion of the seating area and the corners closest to the patient's legs. A midsize table cover may be provided to cover the complete seating area and the corners closest to the patient's legs. On the other hand, a large table cover, such as the table cover of FIG. 7, may be provided to cover the back of the table and the seating area of the table along, and in particular, the corners of the table closest to the patient's leg. The full-size table cover, such as that shown in FIG. 7, may be preferable in some situations and the other table covers preferable in other situations.

Is appreciated that various attributes of the table cover of the invention may be varied as desired. As described above, the particular material used in construction of the table cover may be varied. Relatedly, it is appreciated that particular attributes of the material used to construct the table cover may be varied, such as the durability, stretch ability and thickness, for example. Additionally, the particular color used may be varied as desired.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A table cover for placement on a supporting table, the table cover comprising:

a top portion extending across the supporting table, the top portion including opposing side edges, a back edge, and a front edge;

a pair of opposing side portions disposed on opposite sides of the top portion, each side portion including:

a vertical side portion attached to a side edge of the top portion and running along the corresponding side edge of the top portion, the vertical side portion having a lower edge, and a horizontal side portion attached to the lower edge of the vertical side portion and running along the lower edge of the vertical side portion, each horizontal side portion for extending under a side of the supporting table, each horizontal side portion includes a back side edge and a front side seam edge, the back side edge forming a segment of the back edge;

a front portion attached to the front edge, of the top portion, at an upper edge of the front portion, the front portion having opposing front seam edges respectively attached, at a seam, to a respective side seam edge of a corresponding horizontal side portion, the front portion further including:

a vertical front face attached, at an upper edge thereof, to the front edge of the top portion, the vertical front face further having a lower edge, and a flap attached to the lower edge of the vertical front face along a portion of a width of the vertical front face, and the flap extending under the supporting table, and wherein the flap is defined within the front portion by a pair of slits; and wherein on each opposing side, the seam is disposed outside a corresponding one of the slits.

2. The table cover of claim 1, the top portion, the opposing side portions, and the front portion being integrally formed.

3. The table cover of claim 2, the top portion, the opposing side portions, and the front portion being formed of a single sheet of material.

4. The table cover of claim 1, the seam constituted by a threaded connection between a side seam edge of a horizontal side portion and a corresponding front seam edge of the front portion.

5. The table cover of claim 1, the seam constituted by a laced connection between a side seam edge of a horizontal side portion and a corresponding front seam edge of the front portion.

6. The table cover of claim 1, the vertical front face including an upper "vertical front face" portion and two side "vertical front face" portions disposed on opposing sides of the upper "vertical front face" portion.

7. The table cover of claim 6, the upper "vertical front face" portion and two side "vertical front face" portions forming a continuous surface.

8. The table cover of claim 7, the the upper "vertical front face" portion and two side "vertical front face" portions in the shape of an elongated inverted "U".

9. The table cover of claim 6, on each side, further including an inner face disposed adjacent (a) a corresponding side "vertical front face" portion and (b) a corresponding horizontal side portion.

10. The table cover of claim 9, the inner face including a vertical inner face portion and a horizontal inner face portion.

11. The table cover of claim 10, the vertical inner face portion being adjacent to the side "vertical front face" portion.

12. The table cover of claim 11, the vertical inner face portion being at right angle to the side "vertical front face" portion.

13. The table cover of claim 10, the horizontal inner face portion being adjacent to the horizontal side portion, such that the horizontal inner face portion runs along the horizontal side portion.

14. The table cover of claim 10, the horizontal inner face portion being at right angle to the horizontal side portion.

15. The table cover of claim 10, the vertical inner face portion and the horizontal inner face portion constituting an "L" shaped interior vertical surface.

16. The table cover of claim 10, the horizontal inner face portion of the inner face, the horizontal side portion, and the vertical side portion collectively constituting a wrap-around of a portion of the supporting table.

17. The table cover of claim 1, the flap terminating, on one side, by an inner flap edge, and each opposing horizontal side portions terminating, on one side, by an inner edge, and the inner flap edge and opposing inner edges attached underneath the supporting table, the inner flap edge and opposing inner edges forming the shape of a "U" with the slits being respectively disposed at respective corners of the "U" shape.

18. The table cover of claim 1, the table cover being constructed of a vinyl material.

19. A table cover for placement on a supporting table, the table cover comprising:

a top portion extending across the supporting table, the top portion including opposing side edges, a back edge, and a front edge;

a pair of opposing side portions disposed on opposite sides of the top portion, each side portion including:

a vertical side portion attached to a side edge of the top portion and running along the corresponding side edge of the top portion, the vertical side portion having a lower edge, and a horizontal side portion attached to the lower edge of the vertical side portion and running along the lower edge of the vertical side portion, each horizontal side portion for extending under a side of the supporting table, each horizontal side portion includes a back side edge and a front side seam edge, the back side edge forming a segment of the back edge;

a front portion attached to the front edge, of the top portion, at an upper edge of the front portion, the front portion having opposing front seam edges respectively attached, at a seam, to a respective side seam edge of a corresponding horizontal side portion, the front portion further including:

a vertical front face attached, at an upper edge thereof, to the front edge of the top portion, the vertical front face further having a lower edge, and a flap attached to the lower edge of the vertical front face along a portion of a width of the vertical front face, and the flap extending under the supporting table, and wherein the flap is defined within the front portion by a pair of slits; and wherein on each opposing side, the seam is disposed outside a corresponding one of the slits, and the flap terminating, on one side, by an inner flap edge, and each opposing horizontal side portions terminating, on one side, by an inner edge, and the inner flap edge and opposing inner edges attached underneath the supporting table, the inner flap edge and opposing inner edges forming the shape of a "U" with the slits being respectively disposed at respective corners of the "U" shape.

* * * * *